US007237291B2

(12) United States Patent
Redford

(10) Patent No.: US 7,237,291 B2
(45) Date of Patent: Jul. 3, 2007

(54) COMBINED NUT RECESS CLEANER AND NUT DRIVER TOOL

(76) Inventor: Henry Redford, 4550 N. 24th East, Mountain Home, ID (US) 83647-5106

( * ) Notice: Subject to any disclaimer, the term of this patent is extended or adjusted under 35 U.S.C. 154(b) by 166 days.

(21) Appl. No.: 10/923,970

(22) Filed: Aug. 23, 2004

(65) Prior Publication Data

US 2006/0037147 A1 Feb. 23, 2006

(51) Int. Cl.
*B25B 13/00* (2006.01)
*B25F 1/00* (2006.01)

(52) U.S. Cl. ..... 7/138; 7/142; 7/158

(58) Field of Classification Search ..... 7/138, 7/142, 158, 165; 81/124.4, 439, 441
See application file for complete search history.

(56) References Cited

U.S. PATENT DOCUMENTS 58,924 A * 10/1866 Webster ..... 408/86
74,490 A * 2/1868 Bidwell ..... 7/158
1,323,056 A * 11/1919 Hofmann ..... 7/138
2,735,325 A * 2/1956 Rudd, Sr. ..... 81/439
2,853,723 A 9/1958 Winslow
2,864,273 A * 12/1958 Hentosh ..... 7/142
4,399,723 A 8/1983 Marleau
4,413,937 A 11/1983 Gutsche
4,551,875 A 11/1985 Getz et al.
4,572,035 A 2/1986 Eisenhauer
5,205,685 A * 4/1993 Herbert ..... 408/204
5,787,535 A * 8/1998 Epstein ..... 7/118
6,128,982 A * 10/2000 Gwin, Sr. ..... 81/452
6,446,662 B1 9/2002 Wagner

* cited by examiner

*Primary Examiner*—Hadi Shakeri
(74) *Attorney, Agent, or Firm*—Stephen M. Nipper; Dykas, Shaver & Nipper, LLP

(57) ABSTRACT

A combined nut area cleaner and nut driver tool for manipulating nuts residing in recesses prone to filling with environmental debris. The tool having a body connecting with or forming a handle, a nut (or fastener) driver for connecting with the body and for driving the nut, and a cleaning flange for connecting to the body, this cleaning flange for cleaning the area adjacent the nut before the nut driver engages the nut. Preferably either the nut driver and/or the cleaning flange are able to be retracted in relation to the cleaning flange and/or nut driver.

14 Claims, 3 Drawing Sheets

COMBINED NUT RECESS CLEANER AND NUT DRIVER TOOL

BACKGROUND OF THE INVENTION

1. Field of the Invention

The present invention generally relates to hand held tools, and more particularly relates to tools used to manipulate fasteners located in areas prone to exposure to the elements including, but not limited to ice, sand, mud, etc.

2. Background Information

Many times fasteners are used in external locations where environmental concerns become an issue in manipulating such fasteners. For instance, domestic irrigation and utilities frequently use plastic utility boxes that are buried in the ground, typically at or near the ground surface. Oftentimes, such boxes are fastened shut through use of a fastener (typically a bolt) and/or a nut. To open such a utility box, a user needs to use a nut driver or other tool to manipulate the bolt/nut holding it shut. The term "utility box" herein including (but not limited to): underground power boxes, telephone boxes, fiber optic boxes, underground water meters, and irrigation valve boxes.

To protect the bolt head, hereinafter "nut", when installed in the field, such boxes are typically outfitted with a recess into which the nut rests. A recess is typically utilized so that contact to the external portion of the box (by equipment or materials, etc.) will not cause damage to the nut and/or fastening closure. If such a fastener was damaged, then obviously it may become exceedingly more difficult to remove the fastener and open the box.

One of the problems with having such a recess is that the recess itself is prone to filling with environmental debris. While it may be possible to insert a plug or cap into the recess, thereby preventing such debris from entering in to the recess, typically the recess is left uncovered. Examples of debris that can accumulate within such a recess include dirt, mud, sand and water. Water within such a recess, in the wintertime, will freeze thereby creating a chunk of ice over the nut. If the recess is filled with ice, or other debris, the nut may be completely inaccessible to manipulation. In such an instance, a person wishing to gain access to the box will have to use a screwdriver or pocketknife to scrape within the recess hoping to clear the debris out of the way. In the context of ice, typically the utilization of such a knife or screwdriver in a chiseling action can cause damage to the recess and/or user of said knife/screwdriver.

What is needed is a tool for allowing a user to clean such debris from the area surrounding the nut and also for removing the nut itself. The present invention and/or embodiments of the present invention satisfy this need.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

One embodiment of the present invention is a combined nut area cleaner and nut driver tool. The tool comprising a body, a nut driver, and at least one cleaning flange.

The body having a first end extending to a second end, thereby defining an axis. This first end configured for connection with a handle or comprising a handle. The second end configured for connecting with a fastener (nut) driver. The first end can alternately comprise a square-receiving socket for receiving therein a square boss extending from a handle, such as a square boss extending from a ratchet handle. The first end alternately can have defined therethrough a hole generally perpendicular to the axis, this hole configured for receiving therein a T-handle or rod.

The nut driver connecting to the body, this nut driver terminating in a rim. This rim defining an internal portion preferably configured with a suitable polygonal shape for engaging a nut or other fastener. It is preferred that the nut driver comprise a pentagonal shape. It is preferred that the nut driver and the body be fixed together.

The cleaning flange(s) having a cleaning flange edge. This cleaning flange for cleaning the area adjacent the nut before the nut driver engages the nut. It is preferred that the cleaning flange comprise a plurality of rigid teeth, stiff bristles, knobs, flanges, etc. The cleaning flange can comprise a hole saw having a plurality of rigid teeth.

In one embodiment, the cleaning flange can be configured to be moved from an extended position where the flange extends past the rim of the nut driver (thereby allowing the flange of the cleaning portion to clean the area adjacent the nut) to a retracted position where the nut driver can engage the nut (and the cleaning flange is retracted). It is further preferred that a spring be used to bias the cleaning flange in the extended position and/or in the retracted position.

It is preferred that the cleaning flange further comprise at least one depth gauge on the external portion of the cleaning flange, this depth gauge for controlling the depth at which the cleaning flange can clean thereby preventing damage to the area adjacent the nut to be cleaned (so the flange does not cut into the bottom of the recess). In the preferred embodiment this depth gauge comprising an annular ring on the outside surface of the tool.

Optionally the nut driver can be moved from an extended portion where the nut driver extends past the cleaning flange edge (thereby allowing the nut driver to engage the nut) to a retracted position where the cleaning flange is configured to clean the area adjacent the nut.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
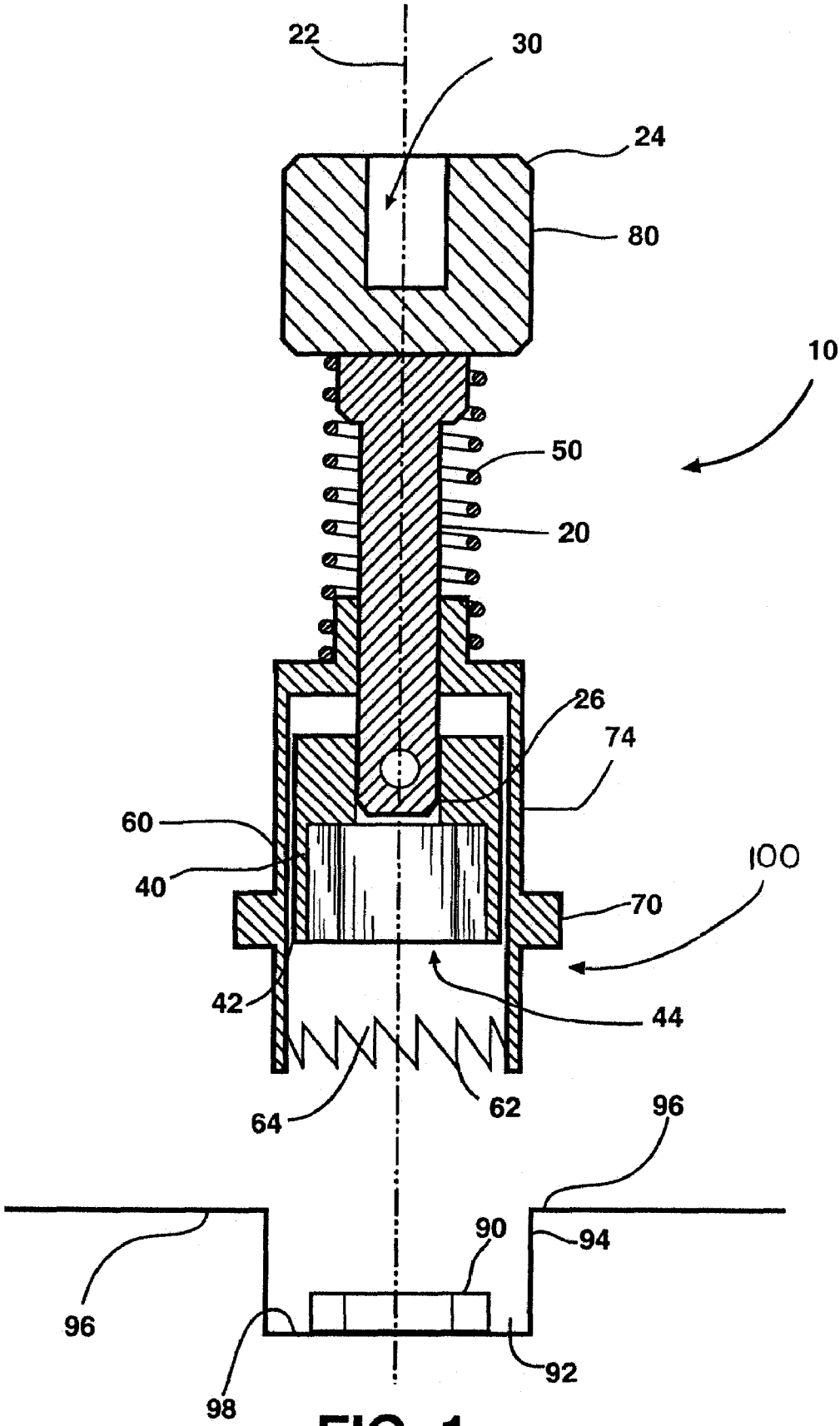
FIG. 1 is a side, cross-sectional, environmental view of one embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a combination tool configured for allowing a utility worker to easily access an outdoor utility box. While the present invention is discussed in terms of such a "utility worker," obviously the present invention's concepts can be applied to other trades as well as uses and the disclosure and discussion of such a "utility worker" is not intended in any way to be a limitation upon its application or use. What is disclosed in this disclosure is envisioned as the primary or principal use of the present invention, and other uses are likewise possible and available.

The present invention is particularly configured for use in accessing utility boxes that are located in outdoor locations. These utility boxes located in outdoor locations are prone to becoming soiled. Typically such a utility box will have a fastener for fastening the lid upon the utility box. This is typically done to prevent and/or frustrate access to the utility box by customers and/or third parties. For example, a utility box may be outfitted with a pentagonal nut and/or bolt head. By being a pentagonal shape, an average homeowner user does not have tools to access said box (a default consumer socket set and/or wrench set having hexagonal shapes).

Such utility boxes typically, because they are located in an outdoor environment, are outfitted with recesses into which the bolt head (hereinafter "nut") are located. This recess configured for protecting the nut from damage. Such a recess may actually be a depression within the utility box and/or lid itself, may comprise a raised portion in the utility box for protecting the nut, etc.

One of the major problems that the present invention solves to overcome is the fact that such a recess can become filled with debris, such as water (which in the wintertime freezes into a chunk of ice), sand, dirt, etc. As such, when a utility worker is faced with needing to access such a box, the utility worker is required to retrieve a screwdriver and/or pocketknife or other device to clean the area (i.e., chip ice out of the recess) adjacent the nut before a nut driver or other fastener remover can be used to remove and/or loosen the nut so that access to the box can be gained. Using such a screwdriver/knife to do the cleaning is both inefficient and exposes the individual to the potential for bodily harm.

The present invention overcomes these difficulties in creating a combination tool that includes both the ability to clean the area adjacent the nut as well as drive the nut itself. While in the preferred embodiment of the present invention the tool has a nut driver for driving a pentagonal nut, obviously other types of fasteners (i.e., hexagonal, octagonal, allen wrenches, torx, bolts, specialty fasteners, screws, etc.) could be driven or manipulated using the present invention including, but not limited to other sizes and shapes of nuts and bolts, screws, etc.

Figure 2:
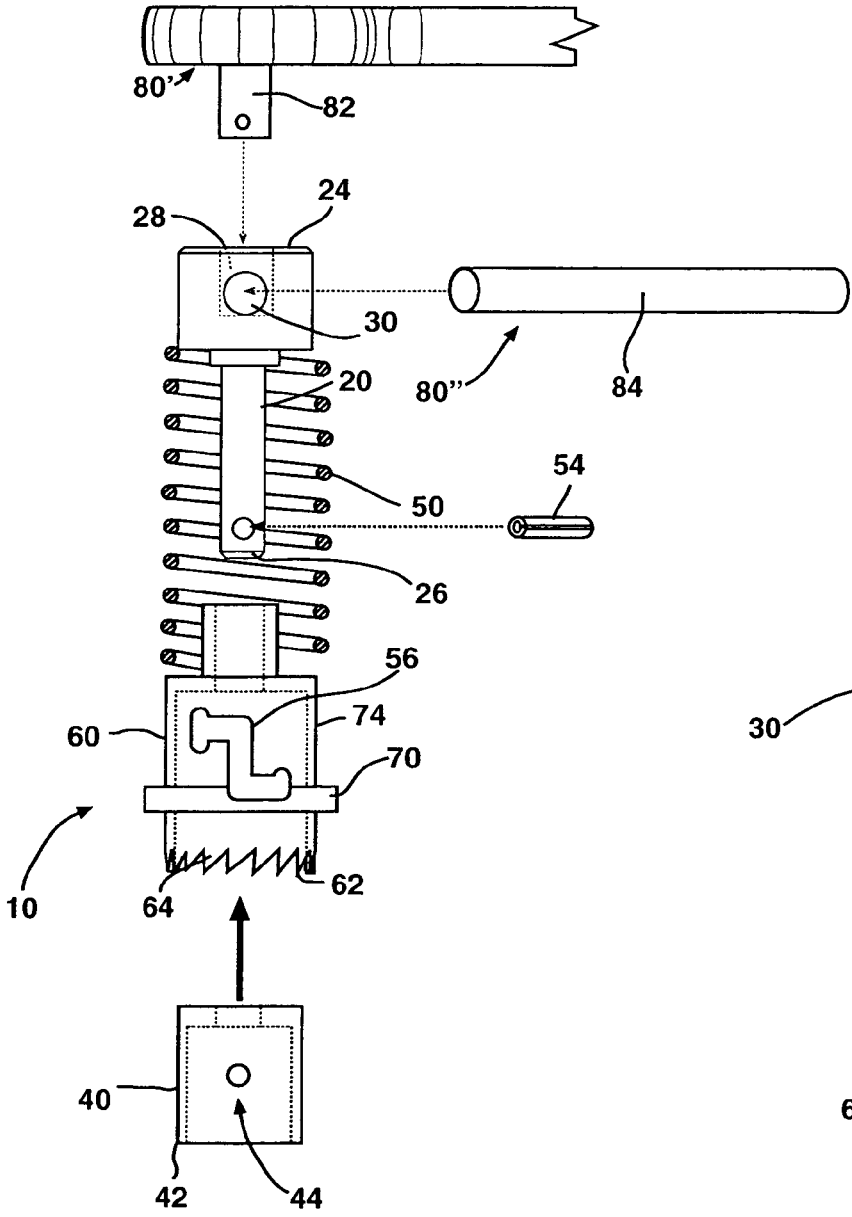
FIG. 2 is a side, exploded, partially cross-sectional, environmental view of the embodiment of FIG. 1.

Referring initially to FIGS. 1 and 2, shown is one embodiment of the present invention. This combined nut area cleaner and nut driver tool 10 having a body 20, a nut driver 40 and a debris removing portion 100 circumvolving the nut driver, this debris removing portion comprising a cleaning flange 60. The body 20 having an axis 22 defined between a first end 24 and a second end 26. The first end 24 either forming a handle 80 (80', 80") or configured for attachment and/or cooperation with such a handle. The words "clean," "cleaning," and the like is used herein to refer to the cleaning, chipping, ice removing, dirt removing, debris removing and other uses of the flange of the present invention. Thus, the word "clean" also could be said to be breaking up, dislodging and removing debris. Ergo, the "nut area cleaner and nut driver tool" of the present invention could likewise be referred to as a combined nut area debris remover and nut driver tool and the cleaning flange could be referred to as a debris removing flange.

Two of the possible handles are shown in FIG. 2. For instance, the handle could comprise a ratchet handle 80' having a square boss 82 extending therefrom. This square boss configured for receipt within a square-receiving socket 28 defined within the first end 24. While this embodiment shows the utilization of the present invention with a ratchet handle, obviously the second end itself could comprise a handle itself (like a screwdriver handle), such as is shown in the handle 80 of FIG. 1, or could comprise other ways of connecting with a handle or manner manipulating, for instance the handle 80" comprising a T-handle 84 and T-handle hole 30, shown in FIG. 2.

The present invention further having a fastener (nut) driver 40 for driving a fastener (nut) 90. This nut driver 40 extending to a bottom end defining a rim 42, this rim itself defining an internal portion 44 of the nut driver having a number of sides or other manners (a nut engaging shape 46) of engaging a fastener such as a nut, bolt, etc. In the embodiment shown, the internal portion defining a pentagonal sided receiving socket for driving a pentagonal nut (however, other shapes and configurations are also envisioned, including but not limited to other polygonal shapes).

In the embodiment shown, sandwiched between the body 20 and the nut driver 40 are a spring 50 and the debris removing portion 100. This spring 50 configured for holding the cleaning flange within its two positions, namely its retracted position (show in FIG. 6) and its engaged or extended position (shown in FIG. 5). These positions are defined later in this disclosure. While the embodiment shown in the drawings shows the use of a spring and S-channel (discussed infra) to move the device into the two different positions, it is obvious that other equivalent structures exist, including, but not limited to the use of snap fits, friction fits, sliding action, threaded action, fasteners, etc.

The debris removing portion 100 having a bottom portion terminating in an edge 62. In the embodiment shown, this edge 62 comprising a plurality of rigid teeth 64. In the embodiment shown, the cleaning flange is essentially a hole saw. In another embodiment (FIG. 4), the cleaning flange can comprise a plurality of stiff bristles 68.

It is preferred that the debris removing portion 100 or the body 20 have an outside surface 74. Along this outside surface 74 is preferably a depth gauge 70 for controlling the depth at which the cleaning flange can clean. In the embodiment shown, this depth gauge 70 comprising an annular ring 72 circumscribing the outside surface 74. Referring to FIG. 1, the depth gauge 70 configured for cooperating with the recess rim 96 defined around a nut recess 94 in which a nut 90 is located. By the depth gauge 70 bottoming out along this nut recess rim 96 (when the cleaning flange comprises a plurality of rigid teeth) the cleaning flange does not cut through the bottom 98 of the recess 94 thereby causing damage to the utility box. The cleaning flange 60 configured for cleaning the area adjacent the nut 92 (i.e., removing ice build up, dirt, and other debris) thereby allowing the nut driver 40 to have access to the nut 90. Some embodiments of the present invention will not have a depth gauge.

The embodiment in FIG. 1 (and the embodiment of FIG. 5) showing the debris removing portion 100 in its extended position whereby the cleaning flange 60 is able to clean the area around the nut 90. Alternatively, the debris removing portion 100 can be retracted either through the utilization of a spring 50 and a generally S-shaped channel 56 as shown in the embodiment of FIG. 2 or other manner. While this is disclosed as the preferred embodiment for manipulation of the debris removing portion 100 from the engaged or retracted positions, obviously other embodiments and manners may also work, including but not limited to threading, and other manners. Likewise, the cleaning flange could be fixed to the body and the nut driver could be the portion configured to move from a retracted to an extended position.

Figure 3:
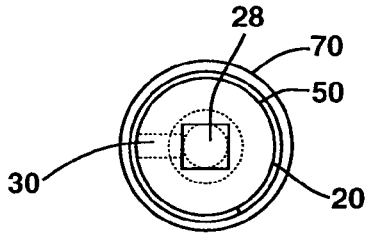
FIG. 3 is a top view of the embodiment of FIG. 1.
Figure 4:
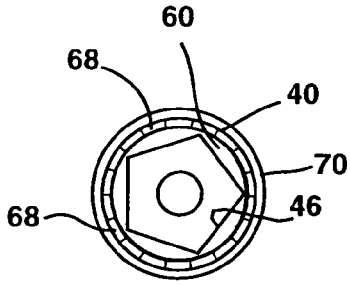
FIG. 4 is a bottom view of the embodiment of FIG. 1.

FIG. 3 shows a top view of the embodiment shown in FIG. 1, showing the body 20, the T-handle hole 30, the square receiving socket 28, the spring 50 and the depth gauge 70. FIG. 4 shows a bottom view of the embodiment of FIG. 1, showing a nut driver 40 having a nut engaging shape 46, debris removing portion 100 having a plurality of stiff bristles 68, and the depth gauge 70.

Figure 5:
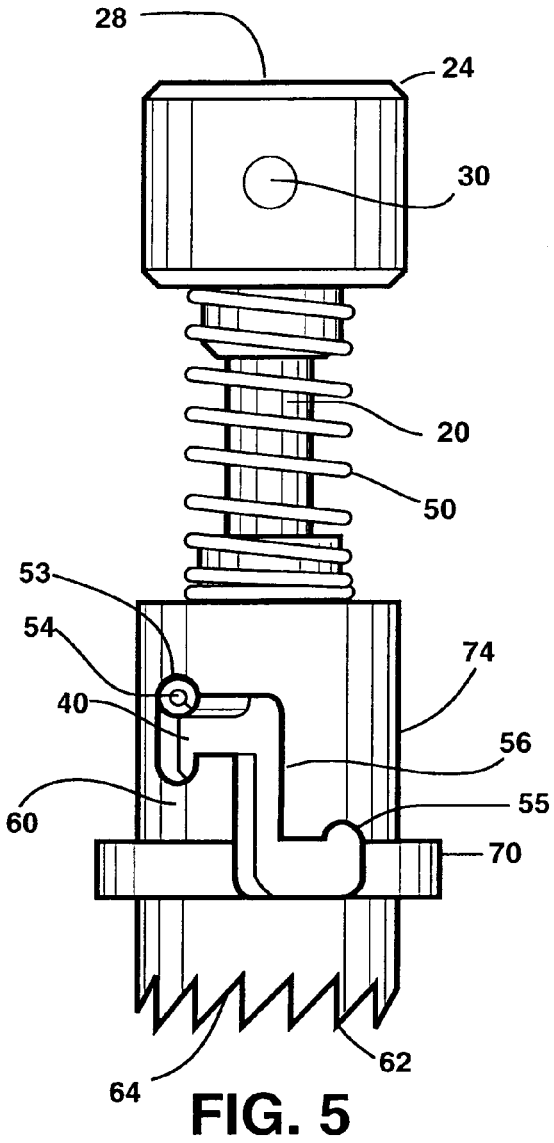
FIG. 5 is a side, partial cross-sectional view of a second embodiment of the present invention showing the cleaning flange extended.
Figure 6:
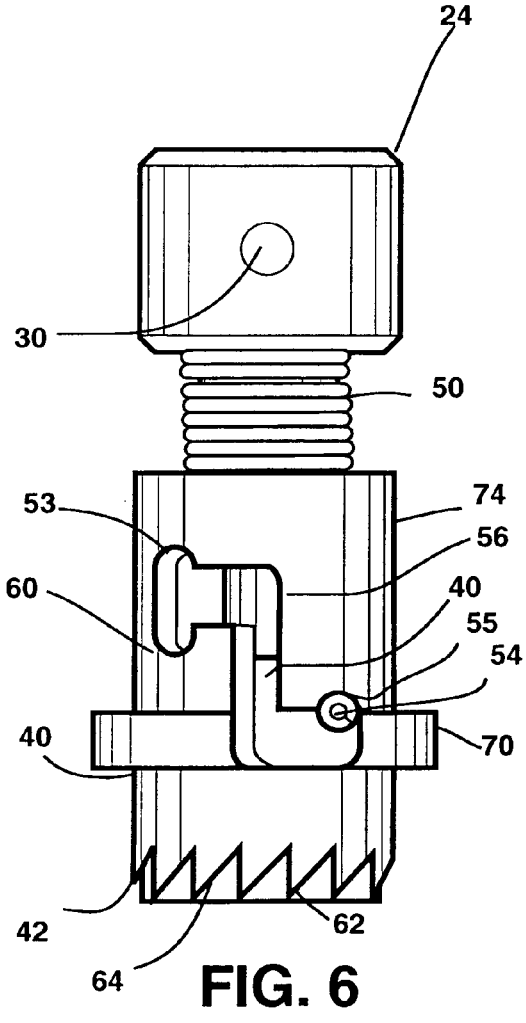
FIG. 6 is a side, partial cross-sectional view of a second embodiment of the present invention showing the cleaning flange retracted.

Referring to FIGS. 5 and 6, shown is the preferred embodiment manner of moving the device from its cleaning mode to its fastener driving mode. Referring initially to FIG. 5, the debris removing portion 100 configured with a generally S-shaped channel 56 there-through. A pin 54 or other protrusion from the body (or nut driver) configured for maneuvering through said S-shaped channel 56. The S-shaped channel 56 having an upper depression 53 and a lower depression 55. In the embodiment shown, the pin 54 is also used to fix the nut driver 40 on the body 20 (holding the spring 50 and debris removing portion 100 there-between). The spring 50 is used to bias the debris removing portion 100 (which puts downward pressure on the nut driver 40). As such, the user can push upwards on the debris removing portion 100, thereby compressing the spring and moving the pin from the upper depression 53 to the lower depression 55 (or vice versa), this movement essentially through rotation and manipulation of the debris removing portion 100. FIG. 5 showing the debris removing portion 100 thus extended and FIG. 6 showing the debris removing portion 100 retracted. Having the debris removing portion 100 retracted is useful should the user want to toss the tool 10 in his/her pocket or toolbox and not have the potentially sharp teeth of the debris removing portion 100 harm adjacent surfaces.

It is preferred that the present invention be made generally from metal, however components of the present invention (if not the entire device) could be made of plastic and/or a composite material.

FIGS. 1–6 showing said debris removing portion and said nut driver body concentric to one another, with said debris removing portion preferably circumvolving said nut driver portion.

It is preferred that the present invention be a single, unitary unit. However, it is expressly envisioned that the present invention could comprise a number of separate pieces, for instance the cleaning flange could be removable (the user could unfasten the cleaning flange piece from the body/nut driver piece).

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A combined nut area debris remover and nut driver tool, said tool configured for removing debris from a utility box nut recess, said nut recess containing a nut, said tool comprising:

a body having an axis, said body extending from a first end to a second end, said first end configured for connection with a handle, said second end for connecting with a nut driver;

a nut driver connecting to said body, said nut driver having a rim defining an internal portion, said internal portion configured with a suitable polygonal shape for engaging a nut;

a debris removing portion circumscribing said nut driver, said debris removing portion having a first end comprising a plurality of rigid teeth, said plurality of rigid teeth for dislodging and removing debris from the area adjacent said nut before said nut driver engages said nut, wherein said plurality of rigid teeth can be moved from an extended position where said plurality of rigid teeth extend past said rim thereby allowing said plurality of rigid teeth to dislodge and remove debris from the area adjacent said nut to a retracted position where said nut driver can engage said nut, and a spring configured for biasing said plurality of rigid teeth in said extended position and in said refracted position.

2. The tool of claim 1, wherein said first end itself comprises a handle.

3. The tool of claim 1, wherein said first end comprises a square receiving socket for receiving a square boss extending from said handle.

4. The tool of claim 1, wherein said first end comprises a hole defined there-through generally perpendicular to said axis, said hole for receiving therein a T-handle.

5. The tool of claim 1, wherein said suitable polygonal shape comprises a pentagonal shape.

6. The tool of claim 1, wherein said nut driver and said body are fixed together.

7. The tool of claim 1, wherein said nut is located within a recess, and wherein said tool comprises at least one depth gauge for preventing the debris removing flange from extending more than a predetermined depth into said recess.

8. The tool of claim 7, wherein said depth gauge comprises an annular ring on an outside surface of said tool.

9. A combined nut area debris remover and nut driver tool, said tool configured for removing debris from a utility box nut recess, said nut recess containing a nut, said tool comprising:

a body having an axis, said body extending from a first end to a second end, said first end configured for connection with a handle, said second end for connecting with a nut driver;

a nut driver connecting to said body, said nut driver having a rim defining an internal portion, said internal portion configured with a suitable polygonal shape for engaging a nut, wherein said nut driver and said body are fixed together; and at least one debris removing flange having a debris removing flange edge, said debris removing flange for dislodging and removing debris from the area adjacent said nut before said nut driver engages said nut, wherein said at least one debris removing flange can be moved from an extended position where said at least one debris removing flange extends past said rim thereby allowing said at least one debris removing to flange to dislodge and remove debris from the area adjacent said nut to a retracted position where said nut driver can engage said nut;

wherein said tool comprises at least one depth gauge for preventing the debris removing flange from extending more than a predetermined depth into said recess.

10. The tool of claim 9, wherein said first end comprises a square receiving socket for receiving a square boss extending from said handle.

11. The tool of claim 9, wherein said suitable polygonal shape comprises a pentagonal shape.

12. The tool of claim 9, wherein said at least one debris removing flange comprises a plurality of rigid teeth.

13. The tool of claim 9, wherein a spring is used to bias said at least one debris removing flange in said extended position and in said retracted position.

14. A combined nut area debris remover and nut driver tool, said tool configured for removing debris from a utility box nut recess, said nut recess containing a nut, said tool comprising:

a body having an axis, said body extending from a first end to a second end, said first end configured for connection with a handle, wherein said first end comprises a square receiving socket for receiving a square boss extending from said handle, said second end comprising a nut driver;

said nut driver having a rim defining an internal portion, said internal portion configured with a pentagonal shape for engaging a pentagonal nut; and a debris removing portion circumscribing said nut driver, said debris portion having a debris portion first end comprising a plurality of rigid teeth, said teeth for dislodging and removing debris from the area adjacent said nut so that said nut driver can engage said nut, wherein said debris removing portion can be moved from an extended position where said teeth extend past said nut driver rim, thereby allowing said teeth to dislodge and remove debris from the area adjacent said nut, to a retracted position where said nut driver can engage said nut, wherein a spring is used to bias said debris removing portion in said extended position and in said retracted position.

* * * * *